US010925356B2

(12) United States Patent
Pellegrino

(10) Patent No.: US 10,925,356 B2
(45) Date of Patent: Feb. 23, 2021

(54) CLASP FOR JEWELRY ITEM

(71) Applicant: JCP SYSTEME LTD., Cagnes sur Mer (FR)

(72) Inventor: Jean-Charles Pellegrino, La Colle sur Loup (FR)

(73) Assignee: JCP SYSTEME LTD., Cagnes sur Mer (FR)

( * ) Notice: Subject to any disclaimer, the term of this patent is extended or adjusted under 35 U.S.C. 154(b) by 0 days.

(21) Appl. No.: 16/609,402

(22) PCT Filed: Apr. 4, 2018

(86) PCT No.: PCT/EP2018/058528
§ 371 (c)(1),
(2) Date: Oct. 29, 2019

(87) PCT Pub. No.: WO2018/202378
PCT Pub. Date: Nov. 8, 2018

(65) Prior Publication Data

US 2020/0054103 A1 Feb. 20, 2020

(30) Foreign Application Priority Data

May 3, 2017 (MC) ..... 2643
Jan. 31, 2018 (MC) ..... 2665

(51) Int. Cl.
*A44C 7/00* (2006.01)

(52) U.S. Cl.
CPC ..... *A44C 7/003* (2013.01); *A44D 2201/32* (2013.01); *A44D 2201/36* (2013.01)

(58) Field of Classification Search
CPC ..... A44C 7/003; A44D 2201/32; A44D 2201/36; Y10T 24/41
See application file for complete search history.

(56) References Cited

U.S. PATENT DOCUMENTS 4,382,317 A * 5/1983 McDonald ..... A44C 7/003 24/705
4,397,067 A * 8/1983 Rapseik ..... A44C 7/003 24/108

(Continued)

FOREIGN PATENT DOCUMENTS

DE 359250 C 9/1922

OTHER PUBLICATIONS

International Search Report dated Jul. 13, 2018 for PCT/EP2018/058528.

*Primary Examiner* — Robert Sandy
*Assistant Examiner* — Louis A Mercado
(74) *Attorney, Agent, or Firm* — Maxwell L. Minch; Maxwell L Minch Esq. PA

(57) ABSTRACT

The present invention provides for a universal stud earring clasp that allows for fastening jewelry and jewelry devices. The present invention facilitates and improves the clasp system for jewelry by providing for a universal fastening device that is particularly compatible with stud earrings, but not limited to stud earring compatibility. The clasp provides for a greater pressure surface and a more ergonomic grip. People from almost all age ranges can handle the clasp, and the clasp is cost-efficient for manufacturing. The clasp also provides for a stud earring clap that is compatible with pins from the ALPA locking system. This invention solves the unmet need of a more secure clasp alternative to existing stud earrings and jewelry items.

11 Claims, 15 Drawing Sheets

(56) References Cited

U.S. PATENT DOCUMENTS

| | | | | | |
|---|---|---|---|---|---|
| 4,425,687 | A * | 1/1984 | Sauer | A44B 9/18 | 24/664 |
| 4,580,417 | A * | 4/1986 | Sardelli | A44C 7/003 | 24/705 |
| 5,023,978 | A * | 6/1991 | Thompson | A44B 6/00 | 24/3.12 |
| 5,337,584 | A * | 8/1994 | Angeli | A44B 1/14 | 24/113 R |
| 5,487,280 | A * | 1/1996 | D'Amore, Jr. | A44C 7/003 | 63/12 |
| 5,588,309 | A * | 12/1996 | Chioffe | A44C 7/003 | 24/705 |
| 5,845,378 | A * | 12/1998 | Karmeli | A44C 7/003 | 24/705 |
| 6,317,941 | B1 * | 11/2001 | Hamm, Jr. | A44C 7/003 | 24/656 |
| 6,557,220 | B1 | 5/2003 | Hamm, Jr. | | |
| 7,089,634 | B1 * | 8/2006 | Dunning | A47C 21/022 | 24/707.4 |
| 8,656,561 | B2 * | 2/2014 | Ingels | A44B 1/18 | 24/103 |
| 9,179,742 | B2 * | 11/2015 | Richardson | F16B 21/073 | |
| 2013/0298603 | A1 | 11/2013 | Baik | | |

* cited by examiner

CLASP FOR JEWELRY ITEM

TECHNICAL FIELD

The present invention relates to clip fastening device for jewelry and jewelry items, and in particular a universal stud earring clasp.

BACKGROUND ART

The conventional earring clasp system, called "ALPA", as shown in FIG. 1A, is widely used in most countries. It consists of a clasp 2 with round pellets 6 or 7 millimeters in diameter with two wings 3 and 4 on the sides, mounted on spring, is and a transverse pin 1 with a notch in which the system comes to lock. By pressing on these two fins 3 and 4, the system opens and allows to release the pin 1. The system is very thin, 2 millimeters, which makes very difficulty the grip of the mechanism, and especially for a whole category of people likely to appreciate the wearing of jewelry and jewelry item.

SUMMARY OF THE INVENTION

It is an object of the present invention to facilitate and improve the use and handling of clasp system for jewelry and more particularly for a stud earring, while ensuring a reliable safety of the latter.

It is also an object of the present invention to provide a universal fastening device for jewelry item, and in particular a clasp for a stud earring providing a greater pressure surface and a more ergonomic grip.

It is a third object of the present invention to provide an stud earring clasp easy to handle, even for people of respectable age, and remains cheap in manufacturing.

It is a fourth object of the present invention to provide an stud earring clasp that is compatible with the pins of ALPA locking systems, to provide a more secure alternative solution for already existing stud earrings and jewelry items.

The invention achieves these objects by means of a clasp for a jewelry article which comprises:

- a base body having a horizontal base pierced at its center with an orifice for receiving a notched pin, the base body comprising a vertical guide cylinder, a first and second support legs (120) each comprising, in their lower part, a bore for receiving an assembly and hinge pin;
- a first jaw comprising two legs each provided with a bore configured to align with the bores of the support legs;
- a second jaw comprising two legs each provided with a bore configured to align with the bores of the support legs as well as those of the first jaw, and to carry out a hinge XX'.

The first and second jaw edges have a slightly convex profile and configured to cooperate with the sides of the support legs of the base body to allow a slight rotation about the alignment axis of the bores and to implement a locking mechanism of a notched pin In a particular embodiment, the base body comprises, above the bores of the first and second legs, a horizontal reinforcing beam connecting the support legs to the guide cylinder.

Preferably, the horizontal reinforcing beam comprises a vertical pin disposed between the guide tube and the support leg and which is configured to receive a return spring for the locking mechanism.

In a particular embodiment, the return spring is a spiral spring having two ends having an angle of between 70 degrees and 110 degrees and preferably equal to 85.5 degrees.

Preferably, the first jaw comprises a first guide groove for guiding a first end of the return spring and, similarly, the second jaw comprises a second guide groove for guiding the first a second end of the return spring.

Thus, guiding the spiral spring at the bottom of the two grooves ensures an effective restoring force allowing the jaws to return to their original position when the pressure exerted on them ceases.

In a particular embodiment, the ends of the spiral spring are curved so as to facilitate their sliding in the guide grooves.

Preferably, the first jaw comprises a first bearing surface and, fixed thereto, a first locking blade having a thickness corresponding to the notching of a rod (1). Similarly, the second jaw has a first bearing surface for supporting and fixing by welding a second locking blade of the same thickness.

Preferably, the first and second locking blades are in the form of a U and are positioned relative to one another so as to configure a central space that can be enlarged with the pressure that the fingers exert on the jaws, causing their slight rotation.

In a particular embodiment, the first and second jaws have the shape of a duckbill having, on the outer surface, a surface profile that increases the feeling of finger pressure that a user may have. Preferably, it can have a notch on the outer surface of these jaws.

In a particular embodiment, the first jaw has a spacing between said first and second legs which is equal to D, and the second jaw (300) has a spacing between said first and second legs which is equal to d, with $d<D$.

Preferably, the base body comprises, at the guide cylinder, a recess for facilitating the introduction of the spiral spring on its pin.

In a particular embodiment, the guide cylinder and the first and second blades are configured to allow the insertion of a rod conforming to the standard ALPA (registered trademark).

DESCRIPTION OF THE DRAWINGS

Other features of one or more embodiments of the invention will appear from the following description of embodiments of the invention, with reference being made to the accompanying drawings.

DESCRIPTION OF THE PREFERRED EMBODIMENT

Figure 1A:
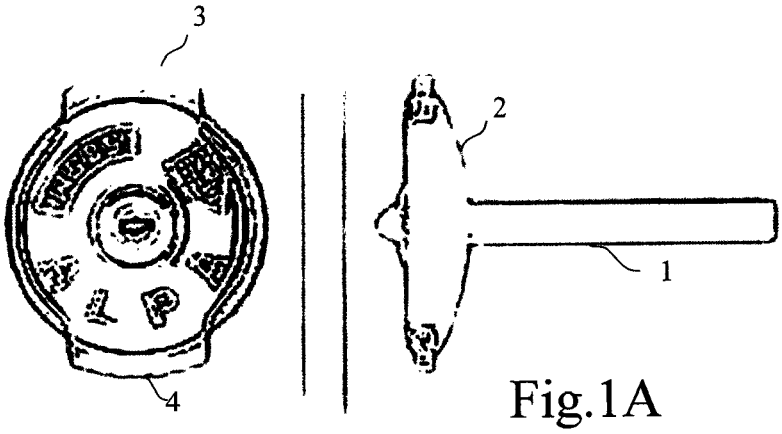
FIG. 1A illustrates the conventional clasp system for earring known as "ALPA".
Figure 1B:
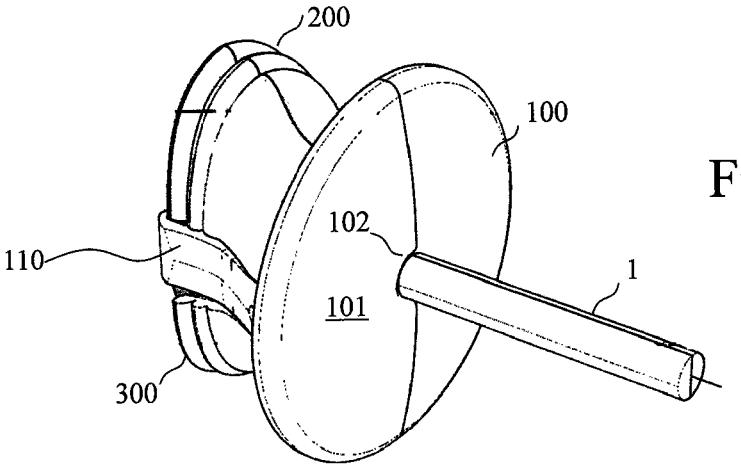
FIGS. 1B and 1C are two perspective views, respectively front and rear, of an embodiment of a clasp according to the present invention.
Figure 1C:
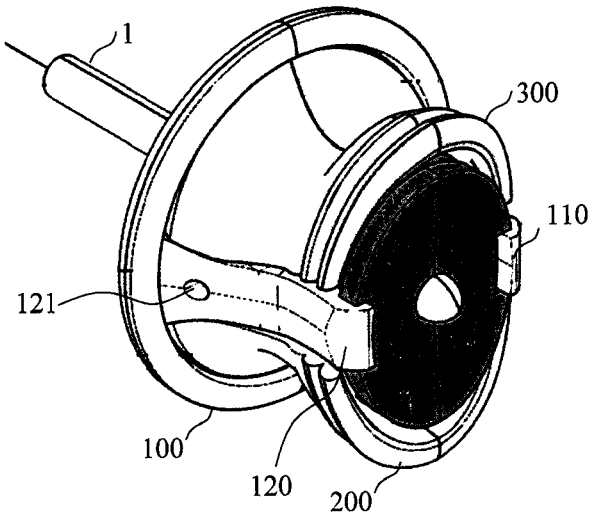

FIGS. 1B and 1C show two perspective views, respectively front and rear, showing the external presentation of an improved clasp ensuring a secure and reliable locking for a pin or rod 1 which could moreover be a pin originally designed for a clasp system "ALPA" (registered trademark).

In this regard, as will be seen in more detail below, the invention proposes an alternative solution for a pair of stud earrings already equipped with an ALPA-type system, in order to replace them with a more secure clasp.

As seen in FIGS. 1B and 1C, the invention consists of a base body 100 having a base 101 slightly rounded to allow a pleasant contact with the ear and provided at its center with an orifice intended to receive a pin or rod 1 which may be an ALPA type rod or any other rod. As is known an ALPA type rod comprises a notch which is based on a groove corresponding to a circular recess for locking the rod. The base body 100 has two support legs 110 and 120 each having in their lower part an orifice (respectively 111, 121) to allow the insertion of a pin 800 (illustrated in FIGS. 7, 9 and 10) providing a hinge allowing a slight possible rotation of two lateral bodies or jaws, respectively 200 and 300, for locking the pin or rod 1.

Figure 2A:
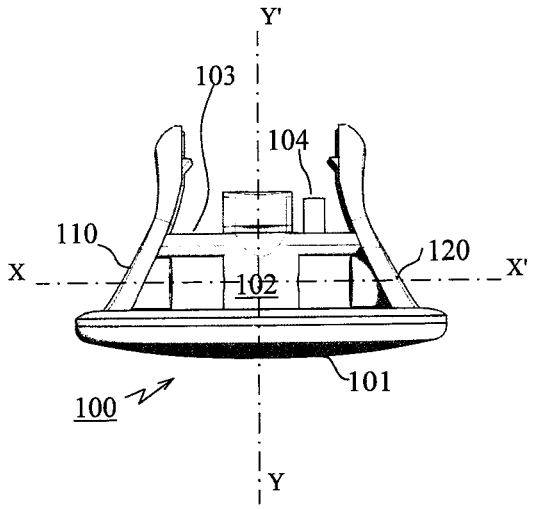
FIGS. 2A and 2B illustrate more particularly a front view and a top view of the base body 100.
Figure 2B:
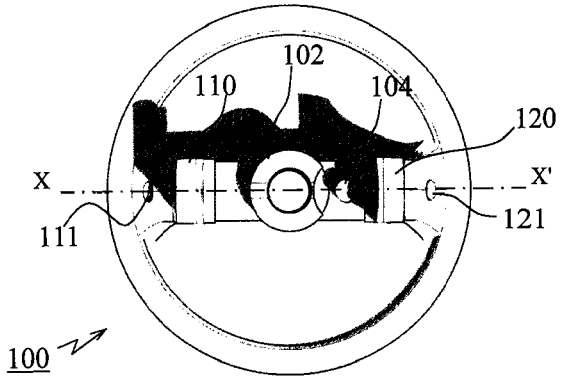
Figure 2C:
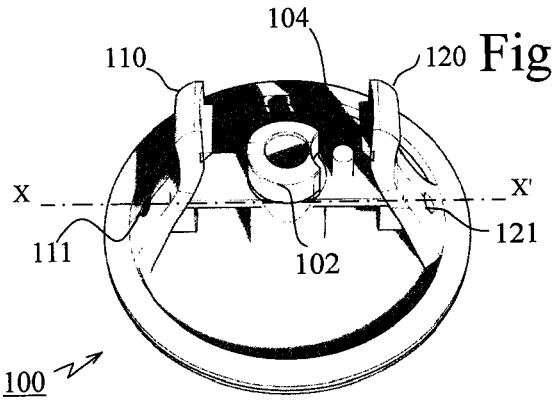
FIGS. 2C, 3A and 3B illustrate three perspective views for showing the details of the structural elements of the base body 100.
Figure 3A:
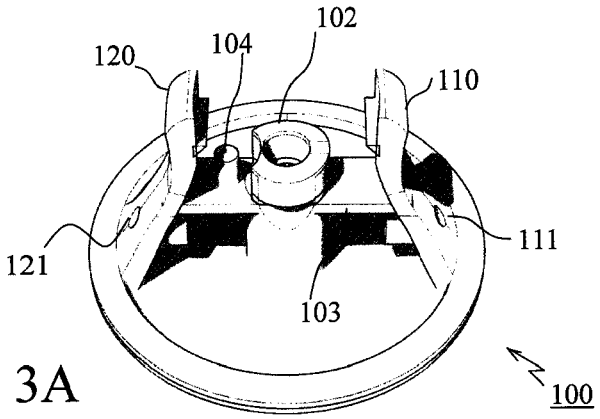
Figure 3B:
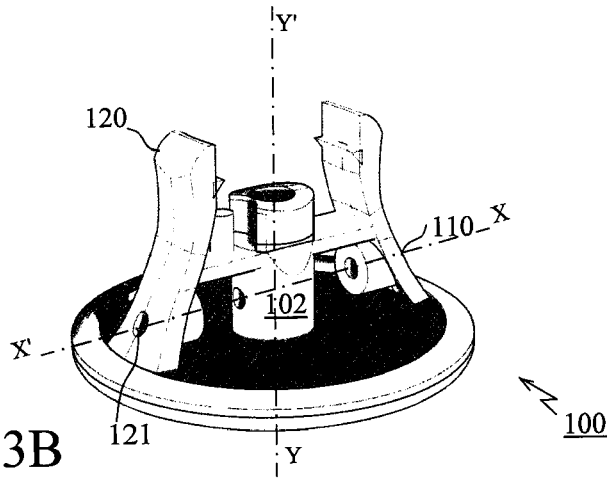

FIGS. 2A and 2B show a front view and a top view of the base body 100, while FIGS. 2C, 3A and 3B more particularly illustrate three perspective views making it possible to show the detail of the structural elements of the base body 100.

The base body 100 comprises, in addition to the two support legs 110 and 120, respectively left and right, a guide cylinder 102 which is arranged at the center of the base body 100 and which is intended to serve as a housing for receiving the spindle or rod 1 of an article of jewelry or jewelry item. As seen in FIG. 2A in particular, the guide cylinder 102 materializes a vertical axis YY'. It should be noted that it performs a dual function of stabilization and reinforcement of the rod 1 so as to protect the latter mechanically against excessive bending.

In one preferred embodiment, the base body 100 further comprises a horizontal reinforcing beam 103 connecting the two support legs 1 and 1 to the guide cylinder in order to stiffen the whole structure. The horizontal reinforcing beam 103 comprises a vertical pin 104 arranged in the middle of the space existing between the guide cylinder 102 and the support leg 120. This pin 104 will be intended, as will be seen later, the positioning of a spiral spring 400 (shown in FIGS. 6, 6C, 6D, 7-10).

FIGS. 2A, 2B, 2C, 3A and 3B also illustrate the positioning, at the bottom of the support legs 110 and 120, of the orifices 111 and 121 which materialize a second horizontal axis X-X' which will serve to receive a assembling and articulation pin 800, as appears in exploded perspective views 7, 9 and 10 which will be described below. In a particular embodiment, the guide cylinder 102 is also pierced on both sides to allow insertion of the pin 800.

It is also noted that the upper part of each of the support legs 110 and 120 comprises a fastening system for attaching a flange or a holding plate 700 for closing the entire mechanism, a once assembled.

We now describe the structural detail of the jaws 200 and 300 which are important elements of the device. Each of the jaws 200 and 300 has a generally semi-circular shape, designed to encompass the entire functional mechanism but also to offer the user a greater pressure surface for the implementation of the mechanism, going well beyond the small surface area of the fins of the conventional ALPA system.

In a preferred embodiment, each of the jaws 200 or 300 has the shape of a duckbill coming to assemble on the hinge XX' of the base body 100. As can be seen in FIG. 11, the edges of the jaws 200 and 300 have a slightly convex profile and configured to cooperate with the sides of the support legs 110 and 120 to allow a slight rotation about the axis XX'.

Figure 4A:
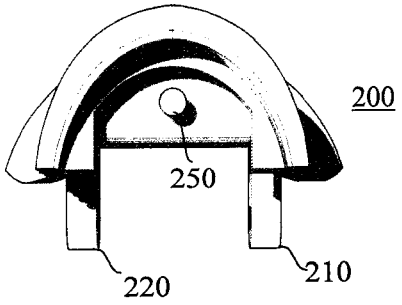
FIG. 4A is a top view of the jaw 200.
Figure 4B:
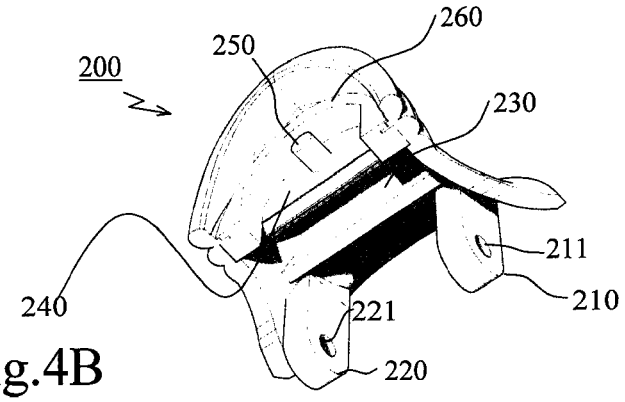
FIGS. 4B and 4C are two perspective views showing details of the jaw 200.
Figure 4C:
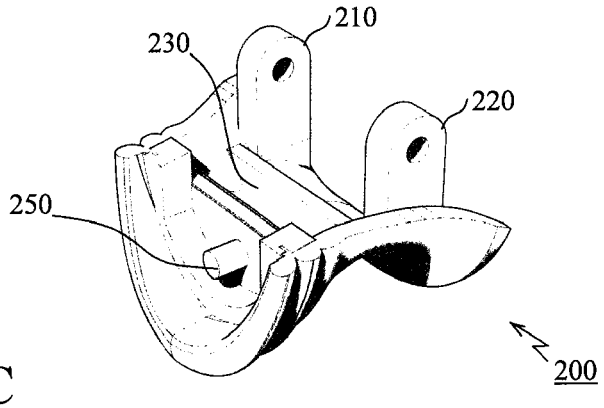

FIG. 4A shows a top view of the jaw 200, while FIGS. 4B and 4C illustrate two perspective views of the same jaw 200. This jaw 200 comprises, in its lower part, two legs 210 and 220 each having a bore 211 and 221 adapted for the passage of pin 800, in order to allow the assembly of the jaw 200 around axis XX' shown in FIG. 3B. The jaw further includes, disposed above legs 210 and 220, a guide groove 230 which will serve, as will be seen later, to guide an end of spiral spring 400.

Arranged above the groove 230, jaw 200 includes a first bearing surface 240 for supporting a first blade 500 (shown in FIG. 7) secured via a pin 250. Jaw 200 further includes a second bearing surface 260 intended for supporting a flange or cover 700 also illustrated in FIG. 7.

In a particular embodiment, blade 500 is fixed to the first bearing surface 240 by welding at the pin 250.

Figure 5A:
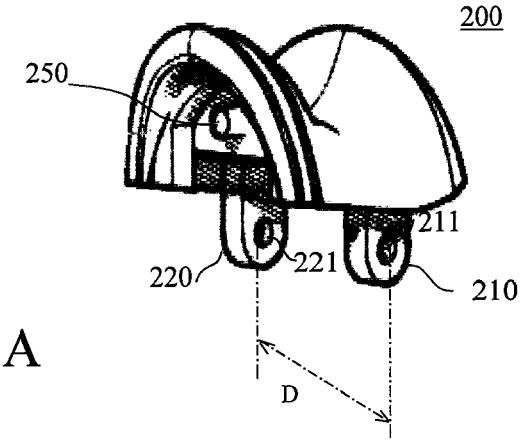
FIGS. 5A and 5B respectively show two perspective views of the jaws 200 and 300.
Figure 5B:
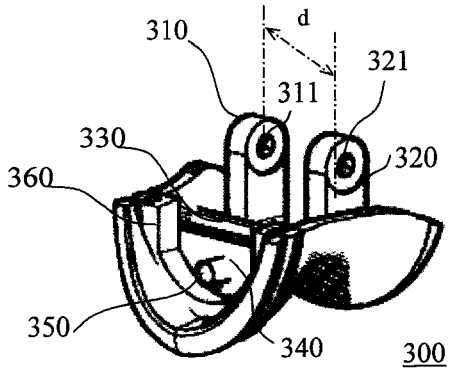

The jaw 300 has a structure similar to that of the jaw 200, as is clear from FIGS. 5A and 5B illustrating, in perspective, the two jaws positioned facing each other. It can thus be observed that the jaw 300 also comprises two legs 310 and 320 each having a bore (respectively 311, 321) for the passage of the pin 800, but also a guide groove 330, as well as two bearing surfaces 340 and 360 intended to serve respectively to support a second blade 600 (fixed via a pin 350) and the flange or cover 700. It will be observed, as is clear from FIGS. 5A and 5B, that the only difference in structure between the jaws 200 and 300 lies in the distance separating the two legs 210-220 (resp. 310-320). The jaw 200 has a spacing D between the two legs 210/220 which is larger than the spacing d between the legs 310/320 of the jaw 300.

This difference in spacing d and D is calculated to allow the positioning of the bores under the beam 103 of the base body 100 and, finally, the assembly of the hinge XX' by the alignment of all the bores 111, 121, 212, 221, 312, 321 and 121.

Figure 6A:
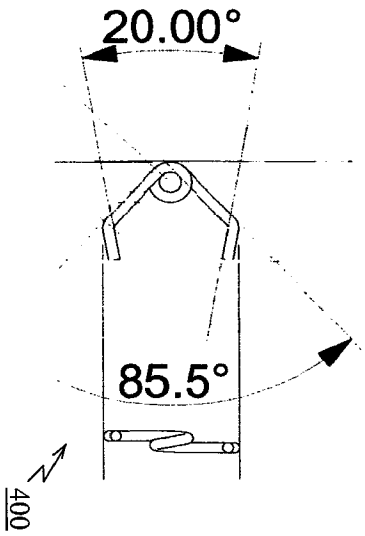
FIG. 6A illustrates the detail of the spiral spring.

FIG. 6A illustrates the detail of the profile of spiral spring 400 intended to be positioned on the pin 104 of the beam 103 of the base body 100. It should be noted, as can be seen in FIGS. 2B and 2C, that a slight circular recess can be arranged on the circumference of the guide cylinder 102 in order to provide sufficient space between the outer contour of this cylinder and the pin 104.

In a particular embodiment, the spiral spring 400 comprises two branches forming between them an angle of between 70° and 110° and, preferably, equal to 85.5°, and each of the branches having a curved end allowing to ensure a smooth sliding at the bottom of the sliding grooves 230 and 330. Preferably, the ends of the branches have, as shown in FIG. 6A, an angle of about 20°.

FIGS. 6B to 6F illustrate five successive phases of assembly of the clasp device.

Figure 6B:
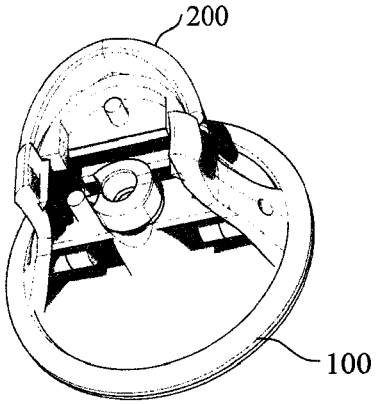
FIGS. 6B to 6F successively illustrate five assembly phases of the clasp mechanism.

In a first phase, as can be seen in FIG. 6B, the jaw 200 is brought closer to the base body 100 in order to align the bores 111-121 of the base body with the bores 211 and 221 of the jaw 200, leaving a free spacing of D between the two bores 211 and 221.

Figure 6C:
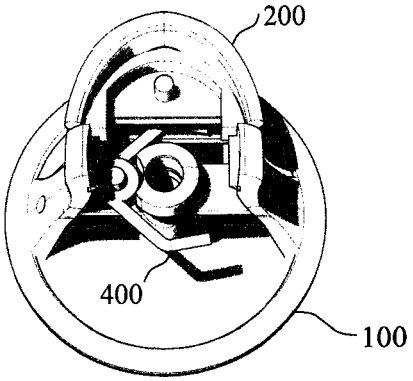

In a second phase, illustrated in FIG. 6C, the spiral spring 400 is positioned on the pin 104 of the base body 100.

Figure 6D:
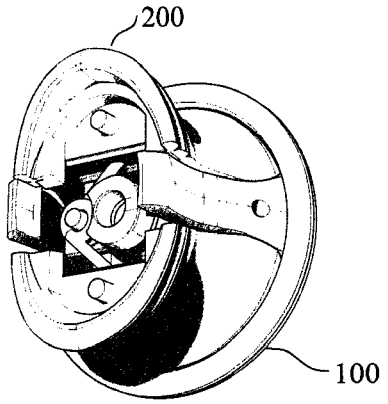
Figure 6E:
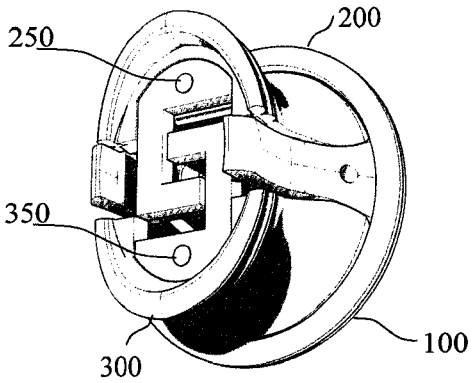

Then, in a third phase, illustrated in FIG. 6D, the second jaw 300 is brought closer to the base body 100 in order to engage the two legs 310 and 320 inside the available space D left by the legs 210 and 220 of the jaw 200.

Figure 7:
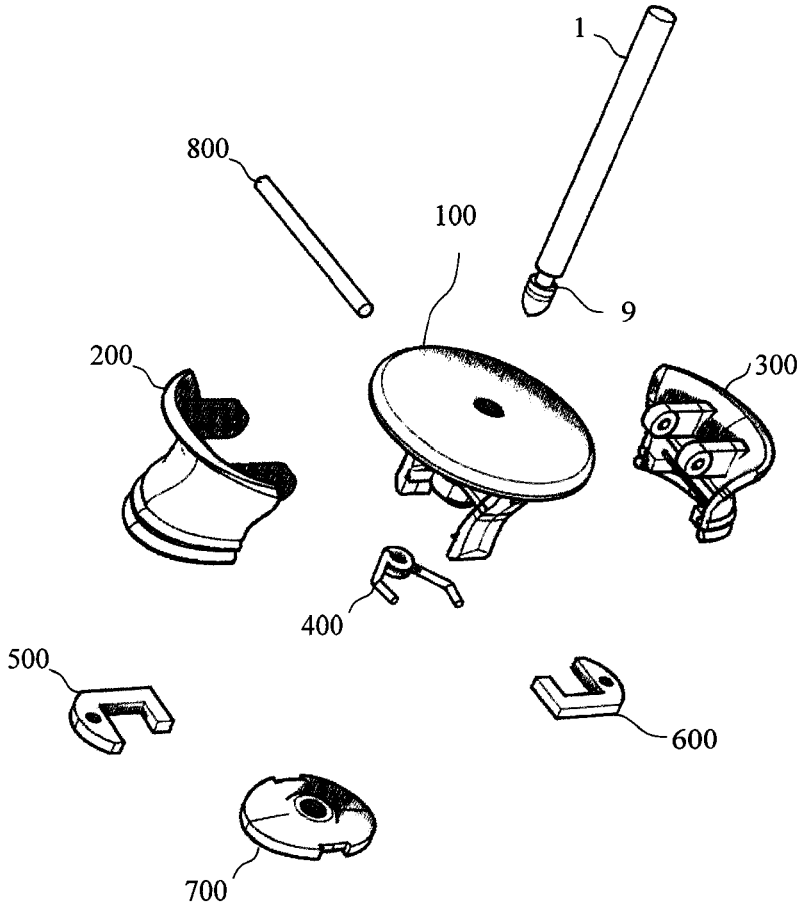
FIG. 7 is a first exploded perspective view of the various components of the clasp.
Figure 8:
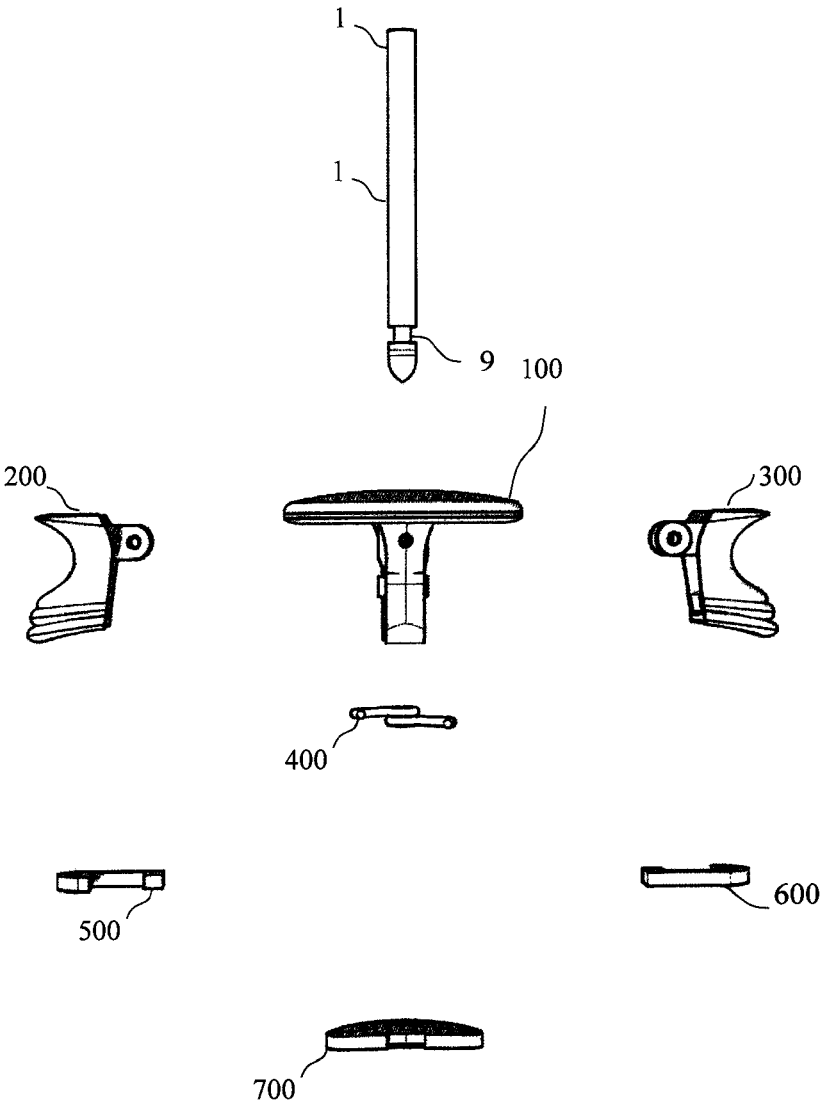
FIG. 8 is a side view of the various components of the clasp.
Figure 9:
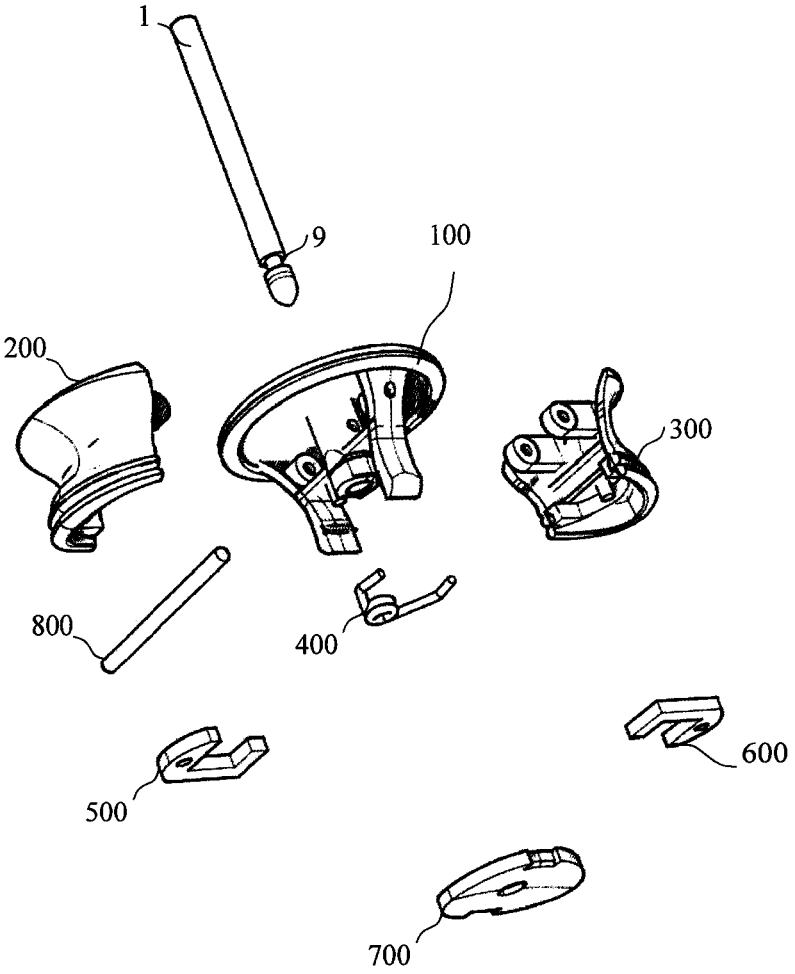
FIG. 9 is a second exploded perspective view of the various components of the clasp.
Figure 10:
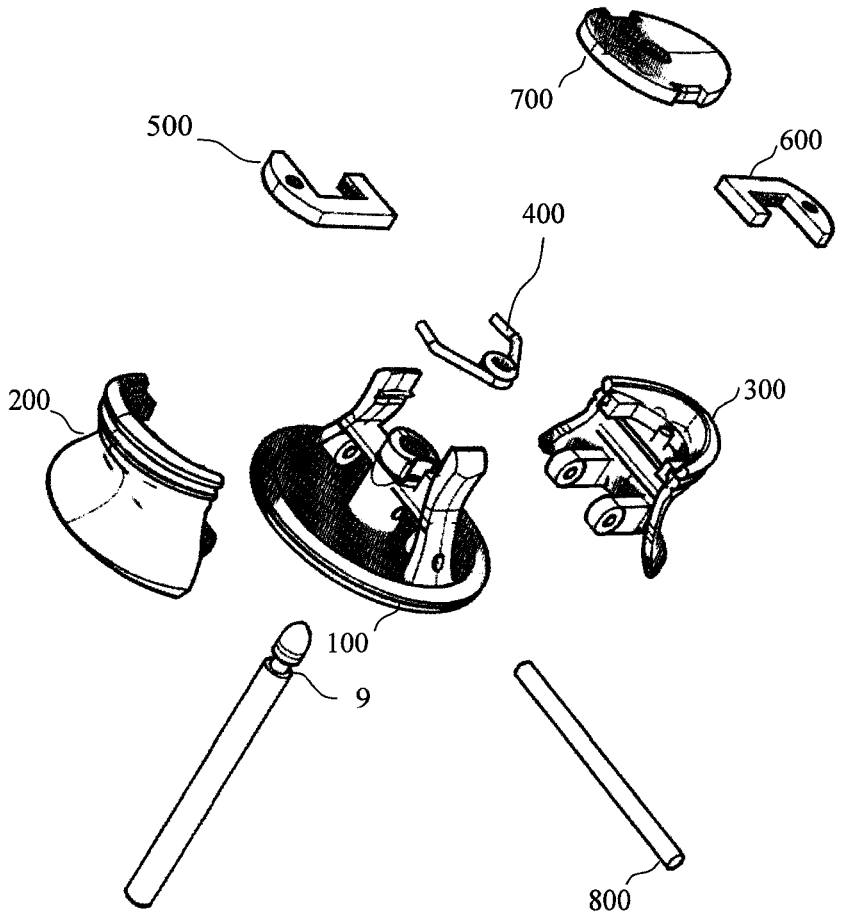
FIG. 10 is a third exploded perspective view of the various components of the clasp.
Figure 11A:
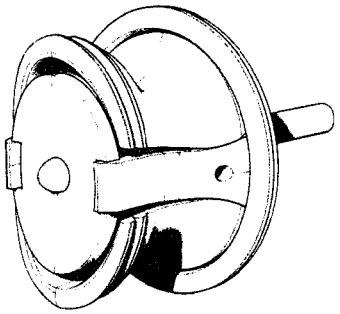
FIGS. 11A, 11B, 11C and 11D show different perspectives of the assembled device.
Figure 11B:
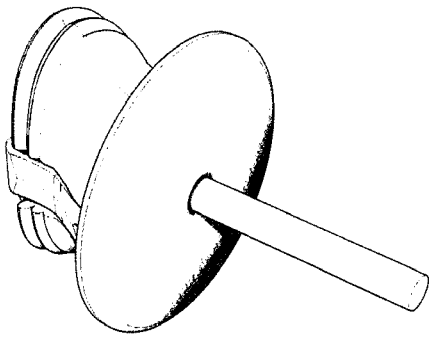
Figure 11C:
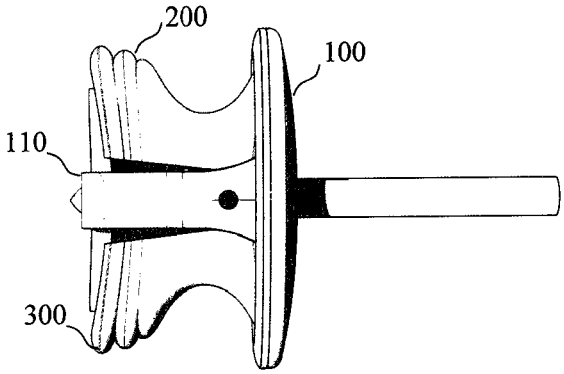
Figure 11D:
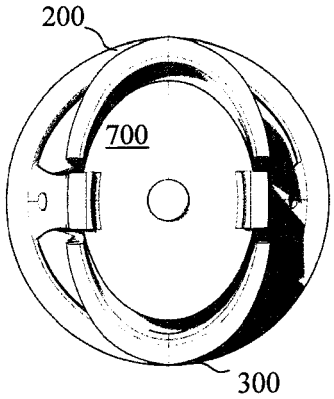

When the spring is positioned so that each of its ends is housed in the corresponding guide groove (230, 330) of the corresponding jaw, one just assemble the hinge XX' by inserting the pin 800—visible in FIGS. 7, 9 and 10—in the alignment of the bores 111, 121, 212, 221, 312, 321 and 121.

This pin 800 can then be welded at its ends 111 and 121 and a final piercing at the guide cylinder 120 will release the internal volume thereof from the central portion of pin 800, so as to allow the insertion of a rod or pin 1.

Then, in a fourth phase, one insert two locking blades, respectively 500 and 600, so as to constitute the locking part of the device. For this purpose, a set of two blades, U-shaped, and having a contour in correspondence with the bearing surfaces 240 and 340 of jaws 200 and 300, respectively. Blade 500 (resp. blade 600) has an orifice which may serve for a fastening on pin 250 (resp. pin 350) of the bearing surface 240 (respectively surface 340) of the jaw 200 (resp. jaw 300).

Figure 6F:
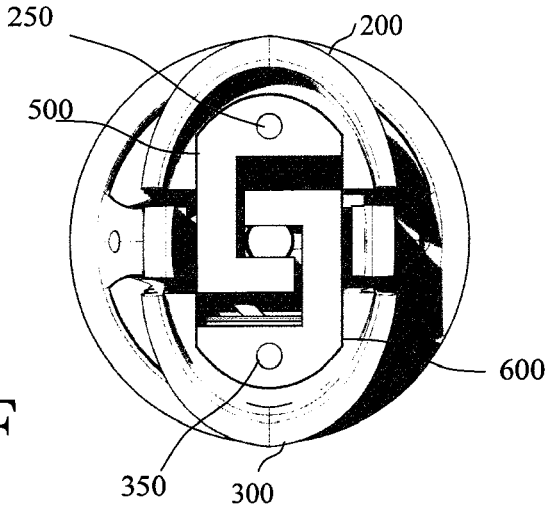

Once properly positioned on their respective pin 250/350, as shown in FIG. 6F, the U-shaped profiles of the two blades 500 and 600 engage one into the other freeing a central space for locking the notch of the rod of the stud earring.

Figure 12A:
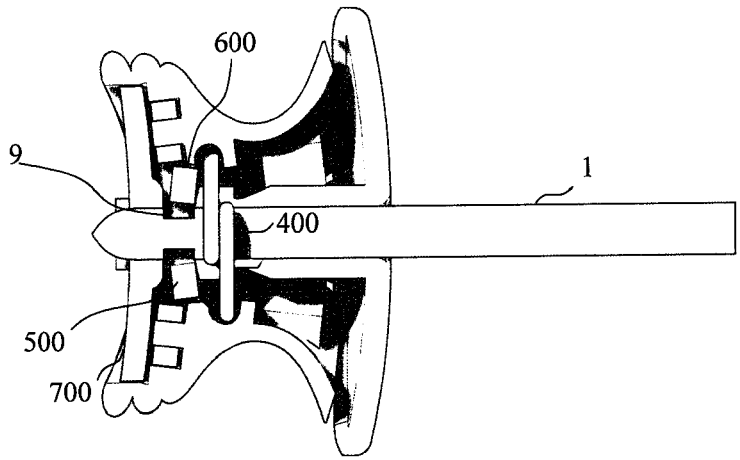
FIGS. 12A and 12B show two sections of the device in the "open" position allowing the release of pin 1.
Figure 12B:
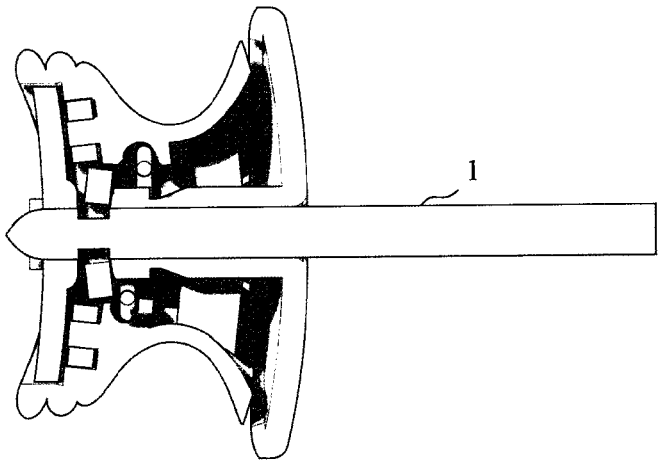

Indeed when one presses, with two fingers, on the outer surface of jaws 200 and 300, the two axes of pins 250 and 350 are brought closer one another. Blades 500-600 being fixed to these same pins, the central spacing then widens, thus releasing the groove of the stud earring or the notch of rod 1, as shown in the sections of FIGS. 12A and 12B.

Figure 13A:
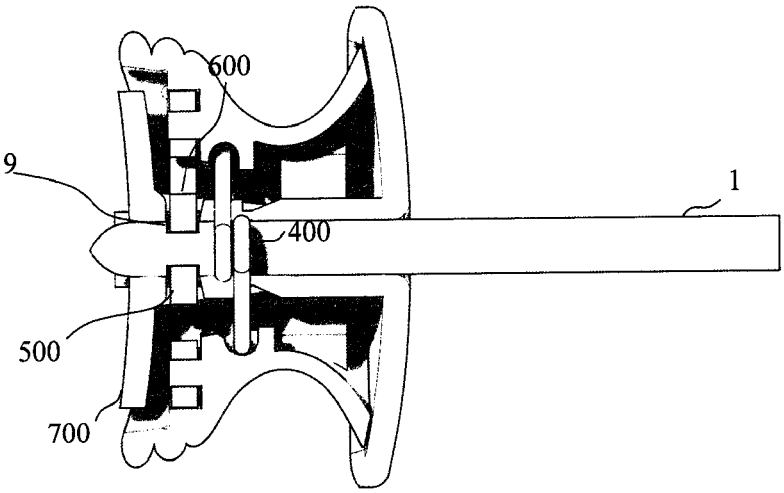
FIGS. 13A and 13B illustrate two device sections in position "Closed", showing the locking of the pin or rod 1, ensuring the security of the clasp.
Figure 13B:
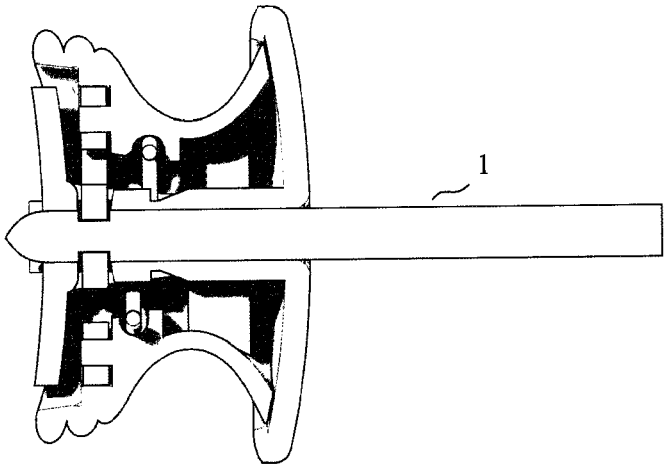

As soon as the pressure on the jaws 200 and 300 is released, the spiral spring 400 exerts a restoring force which then moves the pins 250 and 350 away, which then leads to the return to the initial position, as illustrated in cross views FIGS. 13A and 13B.

Thus, the device allows, very effectively and securely a locking of a rod with one or more locking notches.

Once the device assembled, it can be closed by means of a cover or a flange 700. In a particular embodiment, the cover 700 has, at its center as shown in FIGS. 7-10, a boss making it possible to abut the blades 500 and 600.

In a particular embodiment, it is also observed that the guide cylinder 102 has, in its upper part, a slightly rounded shape to facilitate the respective movements of the blades 500 and 600, resulting from the rotation of the jaws 200 and 300.

Such arrangement achieves a great flexibility in the move of the jaws around hinge XX'.

The clasp is intended, as has been seen, to be associated with a spindle or rod of the notched type, that is to say having at least one groove making it possible to achieve, by combination with the blades of the device, a secure and effectrive locking device.

Finally, to make the use of the device as easy as possible, each of the two jaws 200 and 300 includes, at their external surface, a roughness configured to make it possible to improve the feeling of grip for a user, thus facilitating further implementation of the locking mechanism. When the user presses the two jaws 200 and 300 by grasping them by the toothed portion of the latter, the two jaws rotate slightly about the axis XX'. The blades 500 and 600, welded on the jaws 200 and 300, deviate from the toothed rod, which allows to release the groove or the notch of the rod to tighten the system, or remove it completely.

When the user releases the pressure exerted on the jaws 200 and 300, the spiral spring 400 exerts a restoring force, bringing the blades 500 and 600 welded on jaws 200 and 300, to come closer together, on the adjustment rod 1 and securing the clasp.

The invention claimed is:

1. A clasp device for a jewelry article, the clasp comprising:

a base body (100) having a horizontal base (101) pierced at its center with an orifice for receiving a notched rod (1), said base body (100) comprising a vertical guide cylinder (102), a first support leg (110) and a second support leg (120), wherein the first support leg has in its lower part a first bore (111) intended to receive a horizontal assembly and hinge pin (800), wherein the second support leg (120) has in its lower part a second bore (121) intended to receive said horizontal assembly and said hinge pin (800);

a first jaw (200) having a first leg (210) having a third bore (211) and a second leg (220) having a fourth bore (221), said third and fourth bores being configured to come in alignment with said first and second bores (111, 121);

a second jaw (300) having a first leg (310) having a fifth bore (311) and a second leg (320) having a sixth bore (321), said fifth (311) and sixth (321) bores being configured to come in alignment with said first and second bores (111, 121);

wherein edges of said first and second jaws (200; 300) have a slightly convex profile and configured to cooperate with sides of said support legs (110, 120) to allow a slight rotation about an alignment axis of the bores for a purpose of implementing a locking mechanism of a notched pin.

2. The device according to claim 1 characterized in that the base body (100) comprises, above said first and second bore (111, 121) a horizontal reinforcing beam (103) connecting said support legs (110, 120) to said guide cylinder (120), wherein said reinforcing beam (103) has a vertical pin (104) disposed in a middle of a space between said guide cylinder (102) and the support leg (120), said vertical pin (104) being configured to receive a return spring (400) for the locking mechanism.

3. The device according to claim 2 characterized in that said return spring (400) has two ends having an angle of between 70° and 110° and preferably equal to 85.5°, and wherein said first jaw (200) has a first guide groove (230) for guiding a first end of said return spring (400);

wherein said second jaw (300) has a second guide groove (330) for guiding a second end of said return spring (400);

wherein guiding said first and second ends of said return spring (400) provides a restoring force of the jaws to their initial position when a pressure on said jaws is released.

4. The device according to claim 3 characterized in that the ends of said spring are curved so as to facilitate their sliding in said first (230) and second (330) guide grooves.

5. The device according to claim 1 characterized in that said first jaw (200) has a first bearing surface (250) and fixed thereto, a first locking blade (500) having a thickness which corresponds to said notched rod (1); and said second jaw (300) has a first bearing surface (240) and fixed thereto, a second locking blade (600) having a thickness which corresponds to said notched rod (1);

wherein said first and second locking blades are U-shaped and are positioned relative to one another so as to form a central space which can be enlarged when exerting a pressure will cause rotation of said first and second jaws (200, 300).

6. The device according to claim 5 characterized in that it comprises a cover (700) abutting on said first and second blades, wherein said cover closes the device.

7. The device according to claim 5 characterized in that said guide cylinder (102) comprises, in its upper part, a slightly rounded shape so as to facilitate respective movements of said first and second blades (500, 600) when said first and second jaws (200, 300) slightly rotate.

8. The device according to claim 1, characterized in that said first and second jaws (200, 300) have a shape of a duckbill comprising an outer surface, a surface profile for making it possible to increase a user's feeling of a pressure exerted by his fingers.

9. The device according to claim 1, characterized in that the first jaw comprises a spacing between said first and second legs equal to D, and in that said second jaw (300) has a spacing between said first and second legs equal to d, with $d<D$.

10. The device according to claim 1, characterized in that said base body (100) comprises a recess between an outer contour of said guide cylinder (102) and a vertical pin so as to facilitate an introduction of a spiral return spring (400).

11. The device according to claim 1, characterized in that said guide cylinder (102) and a first and second blades (500, 600) are configured to allow an insertion of an ALPA type rod.

* * * * *